US009510394B2

(12) United States Patent
Legatti

(10) Patent No.: US 9,510,394 B2
(45) Date of Patent: Nov. 29, 2016

(54) ENHANCED SAFETY FOR ELECTRICAL APPLIANCES SUCH AS TOASTERS

(71) Applicant: Raymond L. Legatti, Clearwater, FL (US)

(72) Inventor: Raymond L. Legatti, Clearwater, FL (US)

(73) Assignee: TECHNOLOGY RESEARCH, LLC, Clearwater, FL (US)

( * ) Notice: Subject to any disclaimer, the term of this patent is extended or adjusted under 35 U.S.C. 154(b) by 524 days.

(21) Appl. No.: 13/917,640

(22) Filed: Jun. 14, 2013

(65) Prior Publication Data

US 2013/0334203 A1 Dec. 19, 2013

Related U.S. Application Data

(63) Continuation-in-part of application No. 13/849,530, filed on Mar. 24, 2013.

(60) Provisional application No. 61/615,215, filed on Mar. 24, 2012, provisional application No. 61/659,509, filed on Jun. 14, 2012.

(51) Int. Cl.
*H05B 1/02* (2006.01)

(52) U.S. Cl.
CPC ..... *H05B 1/0261* (2013.01)

(58) Field of Classification Search
CPC ..... H05B 1/0261
USPC ..... 219/491, 492, 493, 494, 497, 501, 505, 219/508, 509, 511, 518; 99/329 R, 329 P, 99/329 RT
See application file for complete search history.

(56) References Cited

U.S. PATENT DOCUMENTS

| | | | | |
|---|---|---|---|---|
| 4,395,621 | A | 7/1983 | Parker | |
| 4,947,155 | A | 8/1990 | Morrow | |
| 5,283,421 | A | 2/1994 | Richards | |
| 5,304,782 | A * | 4/1994 | McNair | A47J 37/0821 219/491 |
| 5,948,305 | A * | 9/1999 | Petrides | A47J 27/62 219/492 |
| 6,084,365 | A * | 7/2000 | Anderson | H02K 7/116 310/83 |
| 6,382,084 | B2 * | 5/2002 | Chan | A47J 37/0842 219/386 |
| 6,525,914 | B1 * | 2/2003 | Legatti | H02H 3/334 361/42 |
| 6,829,123 | B2 * | 12/2004 | Legatti | H02H 3/14 361/1 |
| 7,755,869 | B2 | 7/2010 | Mikrut | |
| 2003/0133236 | A1 * | 7/2003 | Legatti | H02H 3/14 361/42 |
| 2005/0280961 | A1 | 12/2005 | Campolo | |
| 2006/0203402 | A1 | 9/2006 | Aromin | |
| 2013/0247778 | A1 | 9/2013 | Legatti | |

OTHER PUBLICATIONS

Legatti, Raymond L., co-pending U.S. Appl. No. 13/849,530, entitled Enhanced Safety for Electrical Appliances Such as Toasters, filed Sep. 25, 2013, having a common inventor as present invention.

* cited by examiner

*Primary Examiner* — Dana Ross
*Assistant Examiner* — Joseph Iskra
(74) *Attorney, Agent, or Firm* — Patzik, Frank & Samotny Ltd.

(57) ABSTRACT

Enhanced safety for electrical appliance, such as toaster, toaster ovens or rotisseries, is provided by a circuit arrangement which removes power from all or a portion of the appliance upon detection of potentially dangerous conditions as well as activating a visual or audible alarm. The circuit arrangement includes sensors and circuitry for detecting various types of dangerous or hazardous conditions.

14 Claims, 10 Drawing Sheets

ENHANCED SAFETY FOR ELECTRICAL APPLIANCES SUCH AS TOASTERS

This application claims benefit of U.S. provisional application Ser. No. 61/615,215, filed Mar. 24, 2012, U.S. utility patent application Ser. No. 13/849,530, filed Mar. 24, 2013, and U.S. provisional application Ser. No. 61,659,509, filed Jun. 14, 2012.

FIELD OF THE INVENTION

The present invention relates to a circuit arrangement which provides enhanced safety for electrical appliances such as toasters, rotisseries, and toaster ovens.

BACKGROUND OF THE INVENTION

Protective circuit arrangements have been provided in the past to protect electrical devices such as electrical appliances and personnel or users of the devices when undesirable conditions develop within the device. Examples of such arrangements are set forth in the applicant's prior U.S. Pat. No. 6,525,914—Protection System for Devices Connected to an Alternating Current Electrical Power Supply, and U.S. Pat. No. 6,829,123—Device Safety System and Method. While the systems set forth in these patents offer various levels and types of protection for electrical devices, they are, because of the number and type of electrical components involved, and assemble costs, quite expensive when considered as a part of the overall cost of the device in which they are provided for protection. Unfortunately the technology described in those documents was never incorporated into consumer appliances because the manufacturers that were contacted considered that the added cost would be inappropriate for market acceptance.

Manufacturers of electrical appliances are continually trying to reduce the cost of manufacturing the appliances. As the cost of manufacturing the appliance decreases, the relative cost of protective circuit arrangements such as those set forth in the above-mentioned patents becomes much greater, such that the manufacture becomes more reluctant to include them in the appliance. Rather than not include protective arrangements in an appliance, it is desirable to provide protection in a relatively less costly way. The need exists for a protective circuit configuration that addresses consumer safety issues to be available at a cost that could more readily be acceptable to this highly competitive industry, and thus would encourage appliance manufacturers to include it in their products.

While electrical appliances are designed to be reliable and safe to use, unsafe conditions can develop such as due to a failure in a component of the appliance, or due to miss-use of the appliance. For instance, an electrical toaster may present the following unsafe conditions. The elevator carriage may become jammed in the down position, thereby keeping the electrical heating elements activated. Excessive leakage currents from metal parts to electrically live parts such as the elements, may develop, such as caused by a build up of crumbs and grease between the metal parts and electrically live parts. Fire or flames developing within the toaster. A contact being made between the metal frame and electrically live parts by person sticking a metal object, such as a knife into the toaster. It is therefore desirability to include automatic protective features in certain consumer appliances that will contribute to both the protection of property and consumer safety.

In an October 2012 press release, the Consumer Product Safety Commission (CPSC) states that approximately 40% of the residential fires each year are caused by cooking equipment. Additionally, the National Fire Protections Association (NFPA) statistics indicate that 23% of these fires involve ovens or rotisseries, microwave ovens, and toaster/toaster ovens.

Another well known undesirable electrical hazard associated with consumer kitchen appliances such as toasters and toaster ovens is dangerous leakage current which can cause fires resulting in property damage, serious injury from electrical shock or result in electrocutions. Excessive electrical leakage current may occur between accessible metal part and electrically live parts due to contributing situations such as: insulation damage or failure, build up of conductive substances, and insertion of foreign bodies etc. all of which create hazardous conditions.

Fire is also a major safety issue for electrical appliances especially those containing heating elements. Toasters and toaster ovens for example, have a documented history of extremely hazardous fire related events that have and can lead to property destruction and deaths. If such a hazardous fire event occurs it is important to limit the time duration of the fire by removing the power source and if possible to contain the fire in the appliance compartment. For toasters having elevator carriages, it is necessary to maintain the carriage in the down position, so as to avoid it springing up and spreading flaming debris in the area around the toaster. An audible or visual alarm is desirable to bring attention to a hazardous condition.

Protecting the user and an appliance by removing electrical power is essential, for instance, when a consumer inserts a conductive implement into a typical toaster compartment that contains metal supports for the bread or bagel. Protection would be provided, since it would be extremely unlikely for the conductive implement to make contact with the electrically live heating element without also making contact with the metal supports. Protection is also desirable when combustible or conductive material enter the toaster compartment. Protection is also desirable in the case of insulation damage, and when a broken or damaged live electrical element makes contact with a metal case of the appliance.

BRIEF SUMMARY OF THE INVENTION

It is an object of this invention to provide enhanced safety to consumer appliances, such as a toaster at a cost that will allow the general market product sales price be at a level the average consumer can afford. It is a further object of this invention to provide the maximum amount of safety at the lowest possible cost. The present invention offers a simplified but effective solutions for achieving the maximum amount of safety at an acceptable cost.

Toasters and Toaster ovens in particular can certainly achieve a higher level of safety, as they can easily incorporate the enhanced safety techniques of this invention.

In accordance with this invention enhanced safety features are provided to toasters and other electrical appliances. Power is removed from the appliance, when a fire (flame) occurs within the appliance. Removing the power source is essential to limit the time duration in the event of such an occurrence. Further, for elevator type toasters it is important to maintain the elevator carriage in the down position to avoid the spreading of flaming debris outside of the toaster when the elevator carriage pops up. Further, electrical power is removed from the accessible live parts of the appliance when excessive electrical leakage currents occur, or an electrically conductive contact is established between the metal frame and live parts. Further, an audible or visual alarm may be provided in the event of any of the above mentioned situations.

DETAILED DESCRIPTION OF THE PREFERRED EMBODIMENT

In setting forth the detailed description of the drawings, the same numerals will be used for generally corresponding elements in the various figures.

Figure 1:
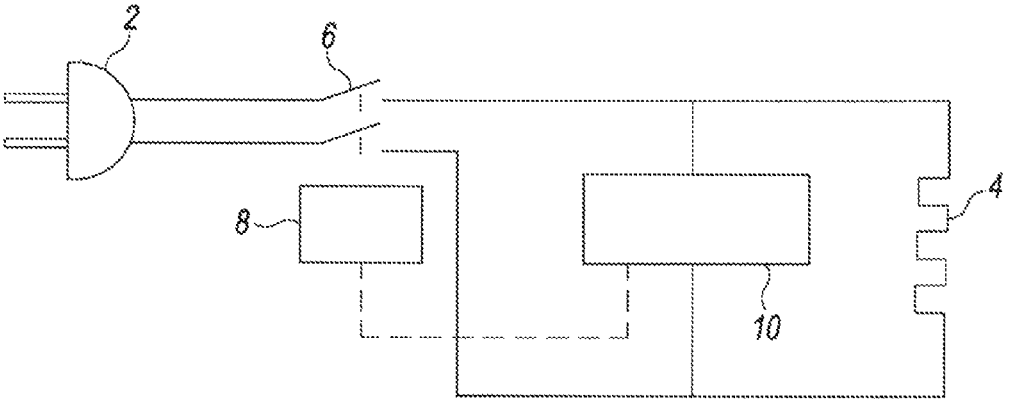
Fig. 1 (Prior Art)
FIG. 1 is a prior art schematic circuit diagram for a pop-up toaster.

Referring to FIG. 1, a basic prior art toaster electrical circuit is shown. The circuit includes a plug 2 for connecting to an AC power source. Electrical heating elements 4 of the toaster are connected to the power source when the contacts 6 of a power switch 8 are closed. To initiate use of the toaster, the contacts 6 are closed, thereby energizing the heating elements 4 and a timer control 10. The opening of the contacts 6, by the power switch 8 is initiated by the release of the toaster elevator carriage by the timer control 10. The contacts 6 or the power switch 8 are mechanically or electrically locked in the closed position until the release of the toaster elevator carriage provides an input to the switch 8 to open the contacts 6.

Figure 2:
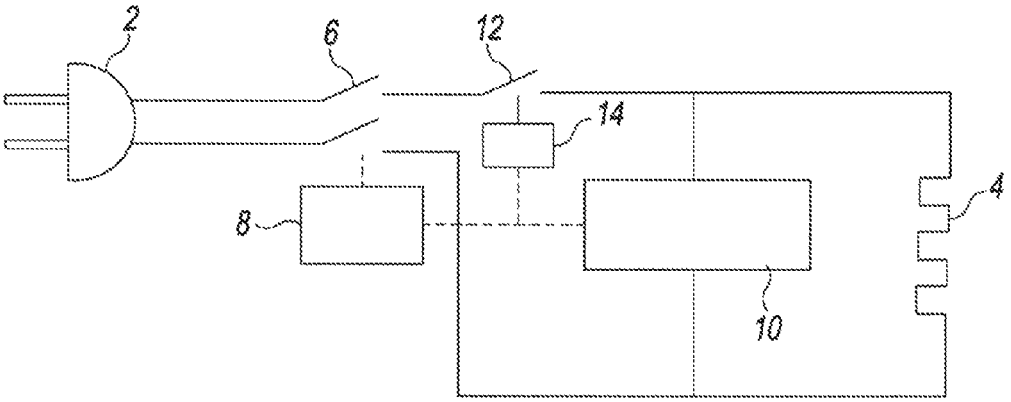
FIG. 2 is a block circuit diagram for a pop-up toaster provided with an alternative power disconnect relay in accordance with this invention.

Referring to FIG. 2, a first embodiment of this invention is shown as applied to a typical "pop up" toaster. The toast elevator carriage may be held down mechanically by a solenoid, or electrically by use of an electromagnet. Again, the carriage pop up release is controlled by the timer control 10, with contacts 6 of the electromagnetic power switch 8 being mechanically or electrically released by an input to the switch 8 caused by the release and popping up of the toaster elevator carriage. The carriage pop up release is controlled by the timer control circuitry. The contacts 6 are spring loaded in the open position, they are closed mechanically by the carriage when pushed down and held mechanically or by an electromagnet. In accordance with this invention alternative power disconnect relay 14 having contacts 12 closed during normal operation is provided to ensure that the heater element power source is removed under fault conditions, particularly when the carriage is maintained in the latched or lower position after presumably being release by the timer control 10. The failure of the elevator carriage to pop-up will result the contacts 6 of the power switch 8 remaining closed, and the heater element 4 continuing to be energized. An example of another adverse condition would be that of a jammed down elevator carriage. With continued heating, the material being toasted may ignite, with a resulting fire. Without the opening of the contacts 6 over-heating and ignition of a fire in the toaster or in surrounding material will result. Popping up of the elevator carriage could result in the distribution of flaming debris outside of the toaster.

The addition of the alternative power disconnect relay 14 is necessary to ensure that the heater element power source will be removed under fault conditions in particular when the elevator carriage is maintained in the latched position after it should have been released under the control of timer control 10. In accordance with this invention, the timer control 10 will provide an input to disconnect relay 14 at a short interval of time after the time for releasing the elevator, to open the contacts 12 to disconnect the heating element 4. While the heating element 4 is de-activated, the power switch 8 remains activated, thereby preventing the release of the carriage, and the adverse consequences that could result from the release, such as discharging in the area of the toaster burning embers from a fire initiated in the toaster compartment. Detectors for other adverse conditions may be provided, which will provide an input signal to the alternative power disconnect relay 14, to open the contacts 12, thereby removing power from the heating element 4.

Figure 3:
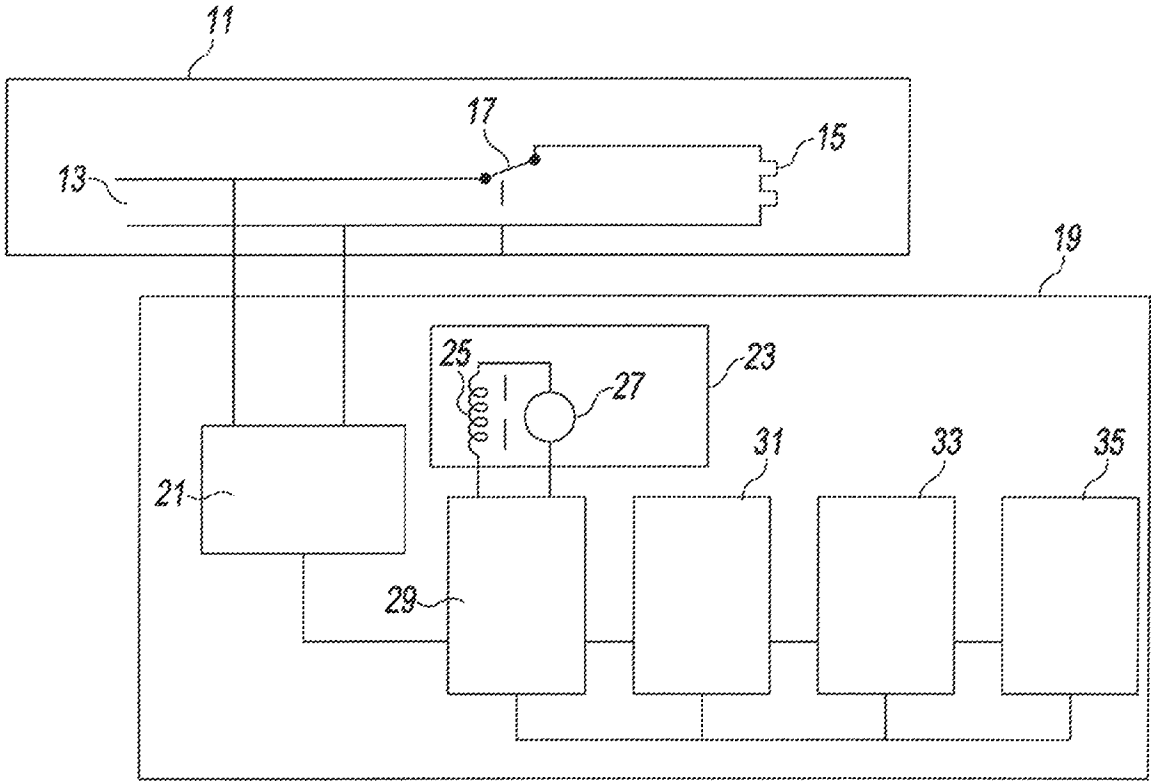
FIG. 3 is a block circuit diagram with an alternative power disconnect relay in accordance with this invention including a variety of sensors.

Referring to FIG. 3, a block diagram of an electrical appliance, such as a pop-up toaster provided with added protection in accordance with a preferred embodiment of this invention is shown. The appliance being protected 11, includes connections 13 to a power supply, the appliance electrical load 15, and circuit interrupter contacts 17. The enhanced safety system of this invention shown as 19, includes a circuit power supply 21, which is activated from a power supply through connection 13. A circuit interrupter and alarm 23 includes a coil 25 for actuating the contact of a circuit breaker to remove power from the appropriate components of the appliance to terminate incipient or action dangerous conditions. An alarm 27 is also activated along with the coil 25. The energization of the coil 25 and alarm 27 is provided by a fault activation switch device 29. The power supplied to the coil 25 and the alarm 27 by the fault activation switch device 29, may vary in magnitude, such that the alarm 27 will be activated at a lower power level than the coil 25, to given advanced warning of a dangerous condition. As shown in FIG. 3, the fault activation switch device 29, may receive fault signals to activate the coil 25 and the alarm 27, from a variety of sensors. Sensors shown are a flame sensor 31, a leakage current sensor 33, and other sensor 35. In an alternative circuit arrangement, the coil of alternative power disconnect relay 14 may be normally activated and the coil de-activated with detection of a fault.

The flame sensor 31 includes a flame responsive element which is positioned in the appliance to detect flame indicative of an incipient or actual fault condition. However, to position the flame responsive element. However, to protect to flames responsive element from excessive heat or potential physical damage, reflectors, refractors, fiber optics or other devices may be included in the appliance to direct a flame, indicative of an incipient or actual fault condition, to the flame responsive element, while locating the flame responsive element in a protected location.

The leakage current sensor 33, configured to sense a leakage current between the live circuit components within the appliance an the metal housing. This leakage current may be due to electrical insulation failure, or the insertion of a metal object in the appliance which establishes a conductive path between live circuit elements and the metal housing. The detection and alarm indication of excessive electrical leakage currents within the appliance could well prevent a serious hazardous event from occurring, and may provide early warning of pending fault conditions such as, insulation failure, carbonized path, and tracking that can lead to dangerous electrical arcing. Further, the build up of grease, crumbs or other electrically conductive substances would provide the consumer user a reason to clean the appliance.

Figure 4:
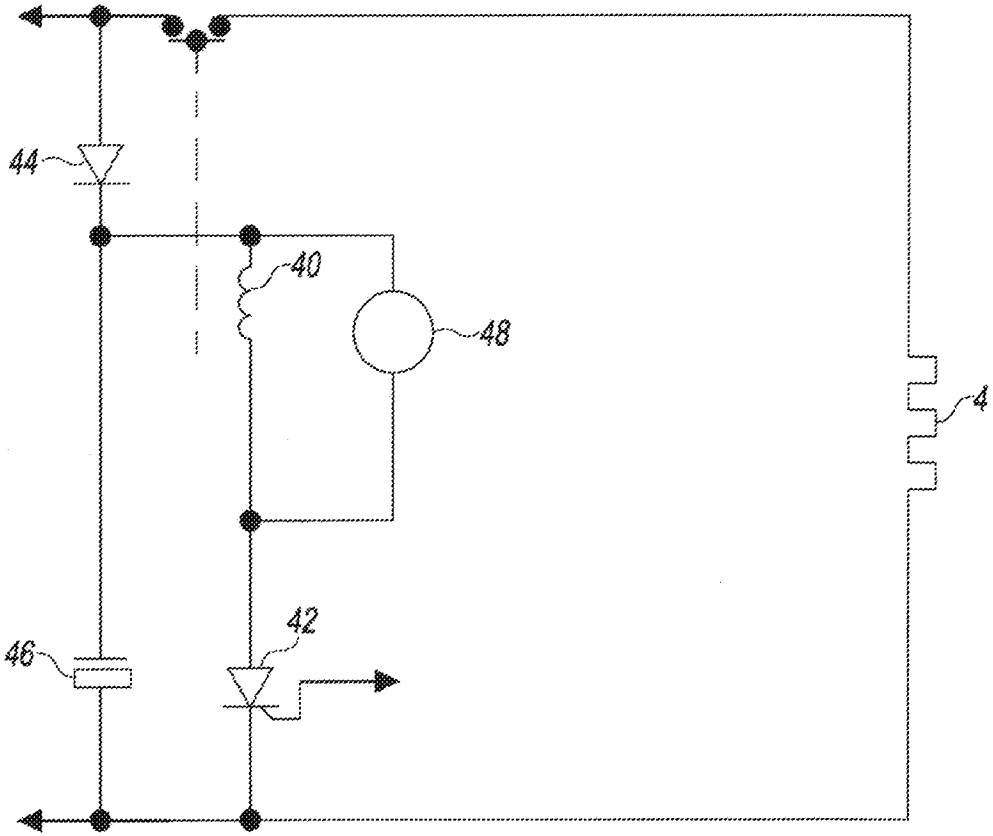
FIG. 4, illustrates the basic circuit configuration of for operating an alternative power disconnect relay in accordance with this invention.

The other sensor 35, is intended to indicate, that sensors which could detect other types of incipient or actual dangerous conditions in the appliance may be provided. FIG. 4 illustrates a basic control circuit configuration of this invention that can accommodate a plurality of and a variety of sensors. The common denominator of the economical enhanced safety approach of this invention is a basic control circuit which in the event of a hazardous situation removes the supply power and provides an audible or visual alarm. As shown in FIG. 4, this consists of a simple circuit consisting of a relay 40 and semiconductor switch 42 which is responsive to signals that are provided by simple fault sensing circuits to be further described. The control circuit includes a diode 44 and a capacitor 46 which form a typical half wave filtered DC supply. Relay 40 is a normally closed supplemental safety relay, it provides the opening of one or more contacts to disconnect power from a circuit or a load, an audible (or visual) alarm (A) can be connected in parallel to the relay coil. Semiconductor switch 42 is shown as an SCR that energizes the coil of relay 40 and the alarm (A) if provided. The coil of relay 40 and the alarm 48 will remain un-energized until a signal of the gate of SCR 42 causes it to become conductive. The SCR gate is connected to a variety of sensors and sensor circuits, which will provide a signal to cause the SCR 42 to conduct when a fault condition is detected. This arrangement has the advantage of minimizing the consumption of power in normal operation, wherein the relay coil is only energized when a fault condition occurs. However, while not as enemy efficient, the SCR 42 could be normally conductive, with the relay energized to keep the relay 40 contacts closed, and when a fault is detected SCR 42 is caused to stop conducting, relay 40 de-energized and its contacts opened.

Figure 5:
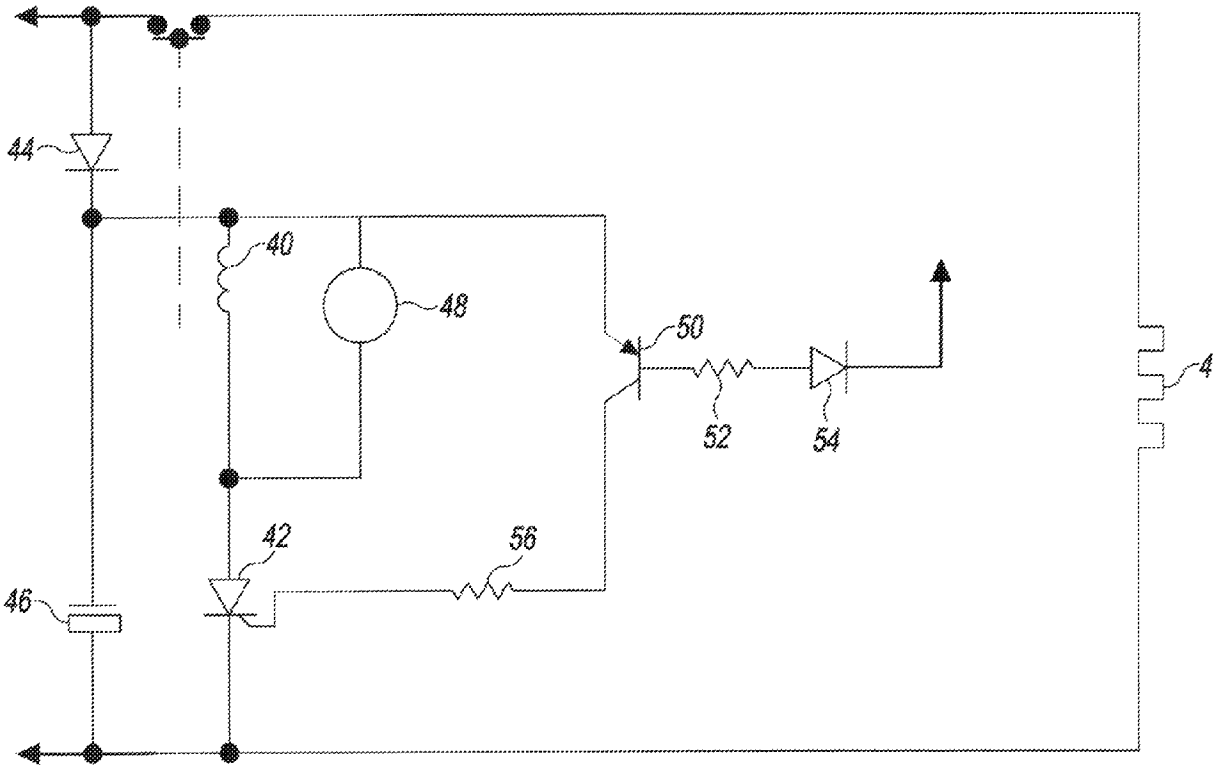
FIG. 5 illustrates the basic circuit configuration of this invention, with electrical leakage current detection for appliances supplied by a two wire cord sets.

FIG. 5 adds to the basic control circuit configuration of this invention as shown in FIG. 4, a sensor circuit for detecting electrical leakage current in an appliance supplied by a two wire cord set. A simplified, but effective, sensor circuit for detecting undesirable leakage currents that could occur between the appliance metal case and electrically live parts of an appliance supplied by a two wire cord set is provided. The base of a transistor 50 is connected through a current limiting resistor 52 and a blocking diode 54 to the metal casing. In the event a conductive path is established between the metal casing and an electrically energized component, 50 will be forward biased, thereby providing a gating signal to SCR 42 through a current limit resistor 56, thereby energizing the coil of relay 40 and alarm 48.

There have been reports of situations where the exposed metal case of an appliance has become electrically above ground potential as a result of supply cord insulation damage caused by being trapped between the appliance and another object. The control circuit shown in FIG. 2 will not offer electrical protection for this situation, since the opened relay 40 contacts are downstream of the fault. However, the alarm will be initiated to provide an alert of the existence of a potentially hazardous situation.

Figure 6:
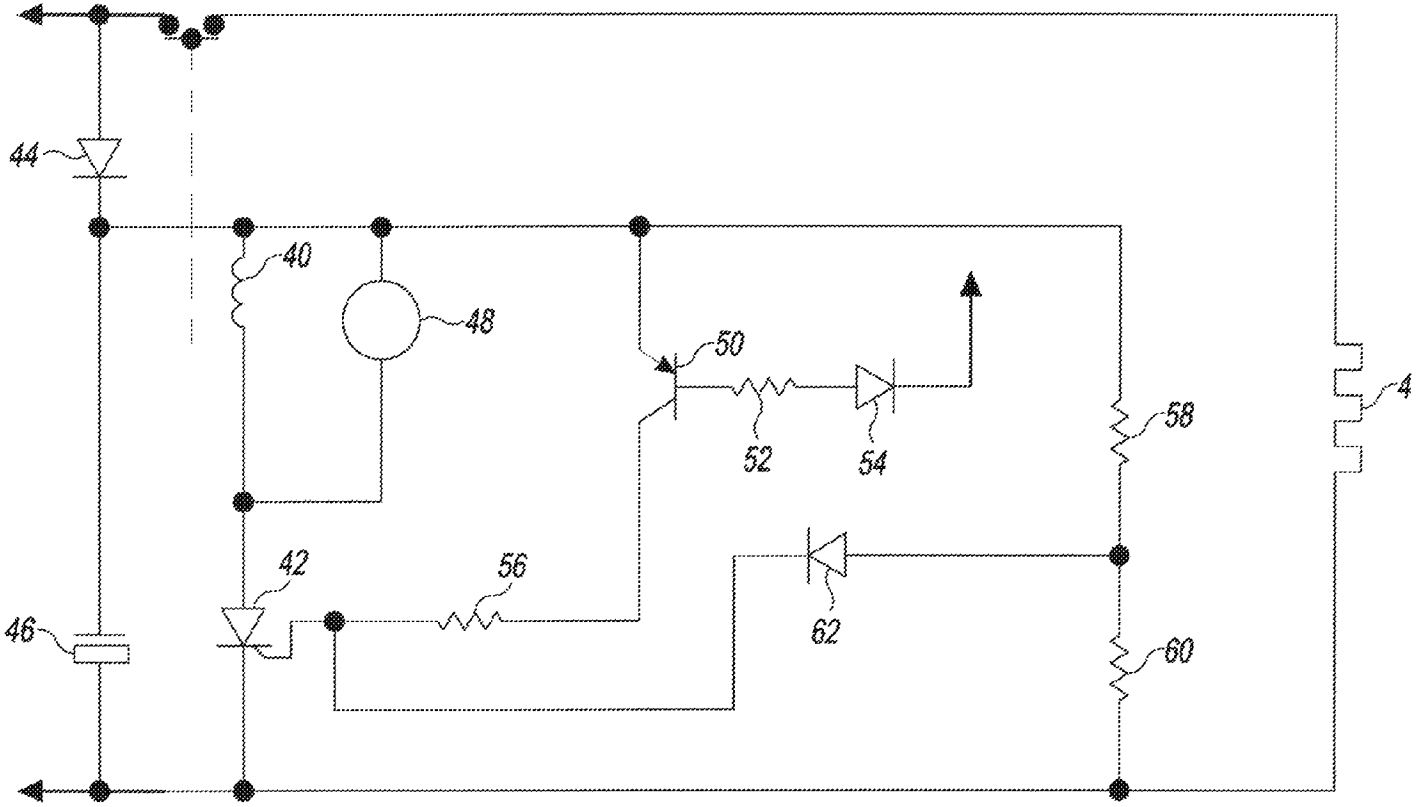
FIG. 6 illustrates the basic circuit configuration of this invention with both flame and leakage current detection.

FIG. 6 adds to the basic control circuit configuration of this invention the leakage current detection of FIG. 5 and flame detection. A simplified but effective sensor circuit for flame detection is provided. The sensor circuit for flame detection comprises a voltage divider arrangement consisting of resistors 58 and 60, with resistor 58 being a light sensitive resistor which is physically located so as to be responsive to the light transmitted from a flame in the appliance. The resistance of light sensitive resistor 58 will decrease as the intensity of the light increases, resulting in an increase of the voltage across resistor 60, thereby creating a gating signal to SCR 42, causing into conduct, so as to energize the coil of relay 40 and thereby remove the power source, and initiating the alarm. Diode 62 is an isolation blocking diode, with the value of resistor 60 setting the detection level. If a fire occurs it can be effectively detected, if light sensitive resistor 58 is suitably mounted to directly or indirectly detect the light transmitted by the flame.

Figure 7:
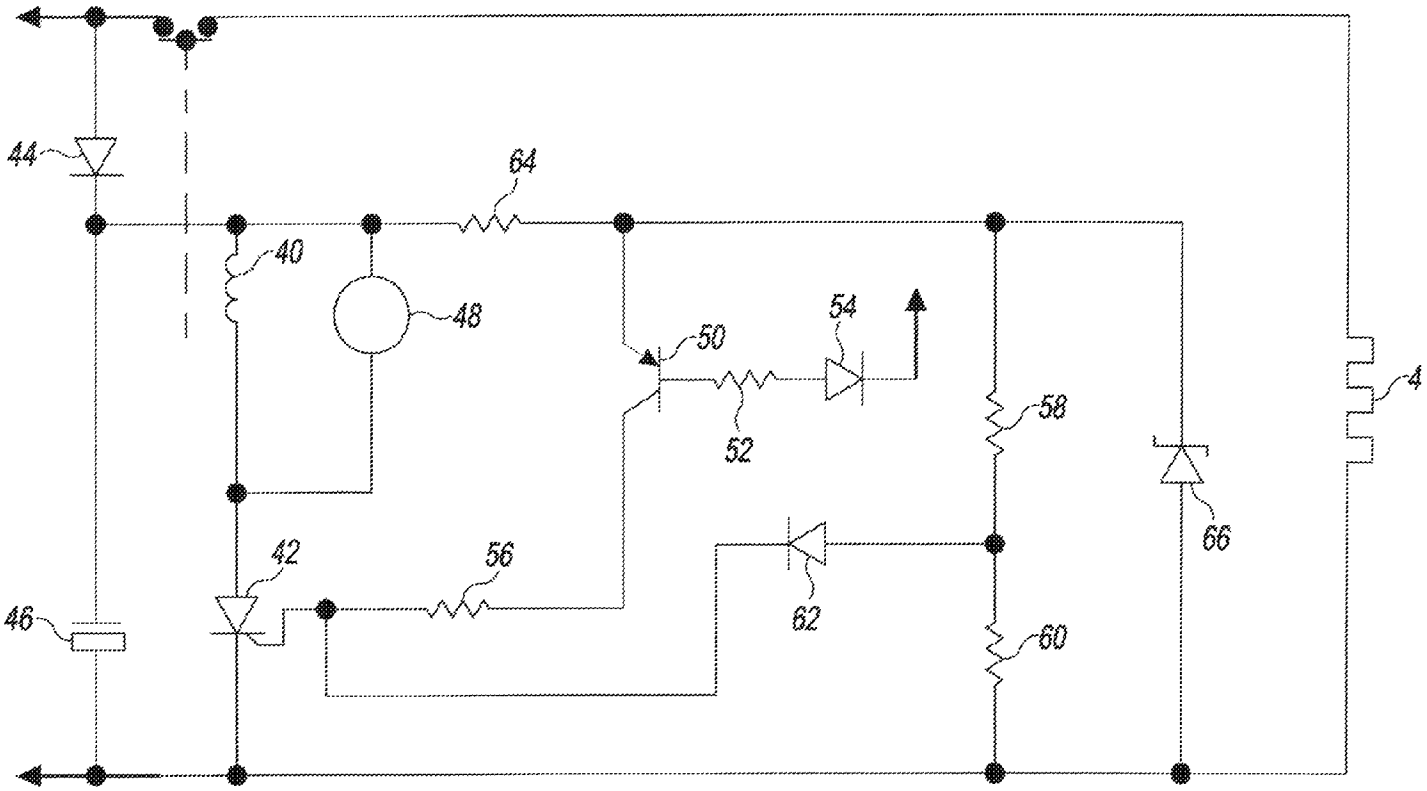
FIG. 7 illustrates the basic circuit configuration of this invention with both flame and leakage current detection and a regulated power supply.

FIG. 7 adds to the basic control circuit configuration of this invention as show in FIG. 6 a regulated power supply comprising limiting resistor 64, and a voltage regulating Zener diode 66. It is important to keep the voltage experience by touching the accessible components of the appliance, and the available current levels well below what is considered by many safety standards as less than 50 volts and 1 mill-ampere respectively, the values and ratings of zener diode 66, and current limiting resistor 64 can be chosen to satisfy this requirement.

Figure 8:
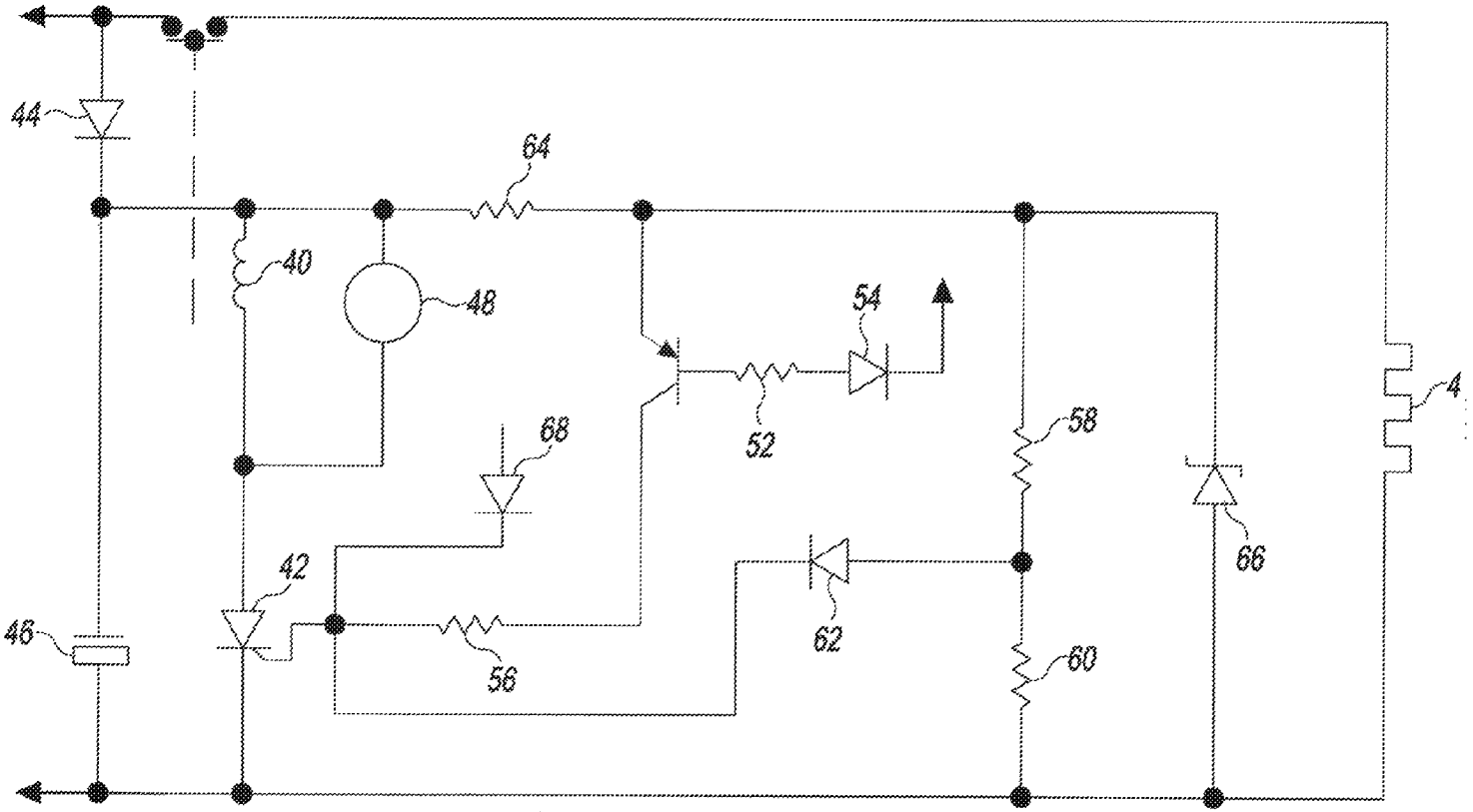
FIG. 8 illustrates the basic circuit configuration of this invention with both flame and leakage current detection, and provision for other sensors inputs.

FIG. 8 adds to the basic control circuit configuration of this invention as show in FIG. 7, the ability to add additional sensors. In accordance with this aspect of the invention, additional sensors can be connected to provide an input signal to SCR 42 through an isolation diode 68. Additional isolation diodes connected in parallel with isolation diode 68 will provide for additional sensors.

Figure 9:
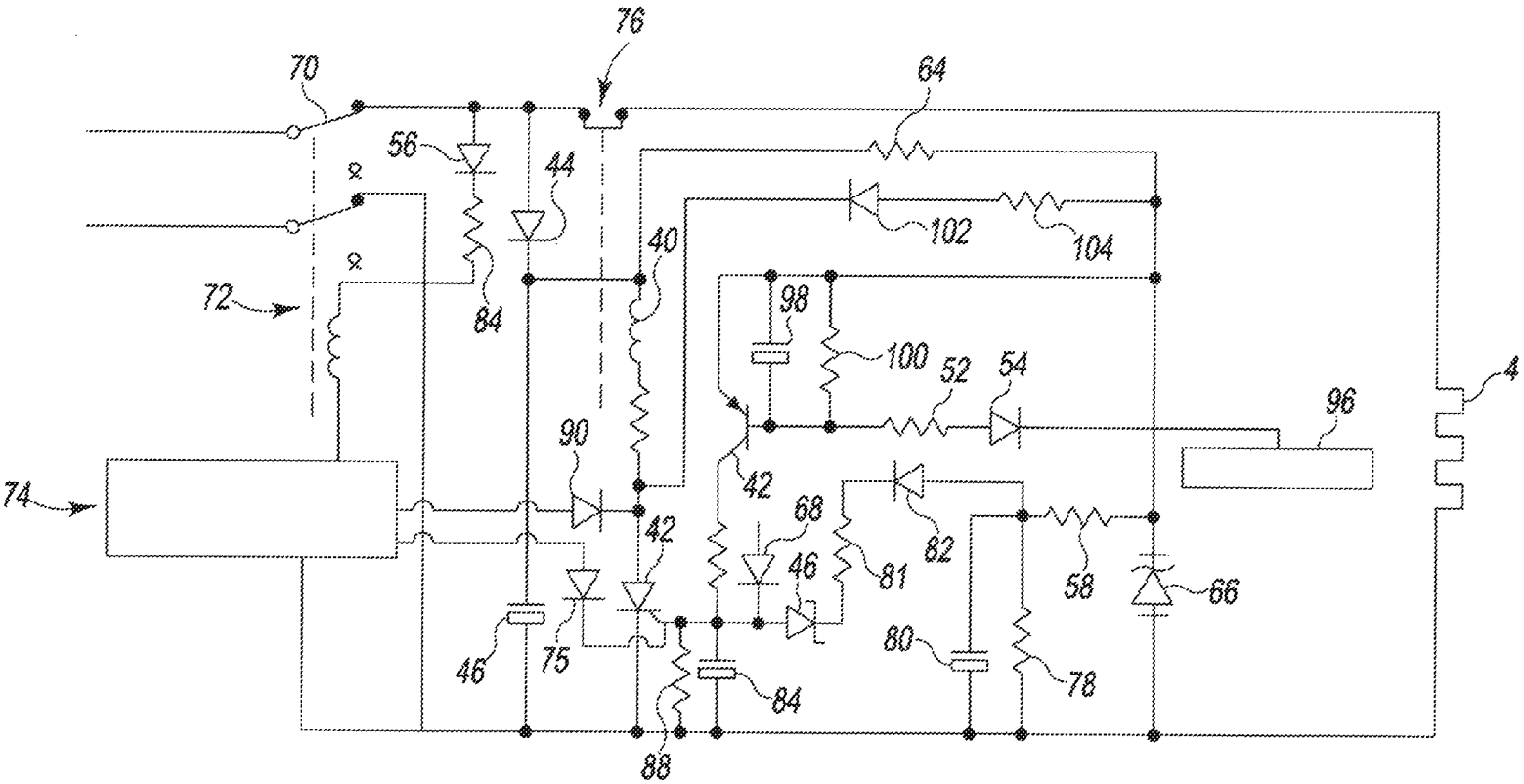
FIG. 9 is a detailed schematic circuit diagram for a pop-up toaster in accordance with a preferred embodiment of the present invention.

FIG. 9 sets forth, a typical basic toaster circuit with details of the added protection and visual display circuit in accordance with a preferred embodiment of this invention. This added protection is provided in the event of: Excessive leakage currents or contact between metal frame and live parts, compartment flame (fire), and a jammed elevator carriage. As in the typical pop up toaster, power is provided to the toaster elements 4 through closed contacts 70 when the spring loaded elevator carriage is held in the down position by the action of either a mechanical latch or an activated electromagnet 72. A timer controller 74 will release the elevator carriage to its up position when the time period for the toaster setting has been achieved, and will remove power from solenoid 72, to open contacts 70, removing power from all circuits within the toaster.

Referring to the specific circuitry of the preferring embodiment of this invention, a DC power supply includes a diode 44 and a capacitor 46, and a voltage regulator formed by a resistor 64 and zener diode 66, which are standard and well known circuits.

In the event of jamming of the elevator carriage in the down position the heating elements 4 may continue to be activated and a fire could result. Should this situation occur, the timer control 74 can be suitably connected to provide a signal to the gate of SCR 42 thus energizing the coil of the alternative power disconnect relay 40 and remove power from the heating elements 4 by opening contacts 76.

If a flame or fire occurs within the toaster compartments a light sensitive resistor or similar light sensitive component 58 positioned within the toaster will detect the scattered or emitted light that is created and gate SCR 42 through a time delay circuit which includes a resistor 78, a capacitor 80, a resistor 81, a diode 82, a capacitor 84, a zener diode 86, and a resistor 88, into a conductive state energizing the coil of alternate power disconnect relay 40 and removing the power source from the heating elements 4 by opening contacts 76. It is important to maintain the elevator carriage in the down position to prevent the spreading of flaming debris. This is accomplished is the case of a mechanically latched solenoid 72 arrangement by removing, the power source to solenoid 72 or the timer control 74 when the coil of alternate power disconnect relay 40 is activated. Alternatively, in the case of a solenoid 72 electro magnet arrangement power may be maintained to the relay coil 40 through a diode 90, a diode 92 and a resistor 94.

It is also desirable to remove power from the toast if any contact is made between the metal casing of the toaster and electrically live parts. For example, a user of the toaster might try to dislodge a slice of bread with an electrically conductive implement Removal of the power is accomplished by detecting low level electrical current flow between the metal casing of the toaster and an electrically live part. A contact between the metal casing 96 and an electrically live part is detected by the circuit consisting of resistor 52 and diode 54. The detection of a low level electrical current through resistor 52 and diode 54 is applied as a forward bias to transistor 50, thereby providing a gating signal to SCR 42 and energizing the solenoid of alternate power disconnect relay 40, opening contacts 76 to de-energize the heating elements 4.

To further describe the circuit of the preferred embodiment of this invention, capacitor 98 and resistor 100 provide noise and detection level control. A series circuit of a light emitting diode 102 and a resistor 104 is connected in parallel with alternate power disconnect relay 40, thereby providing a visual fault display. An audible fault indication could be provided by using a piezo or similar type alarm connected in place of, or in parallel with the light emitting diode 102 and resistor 104.

Figure 10:
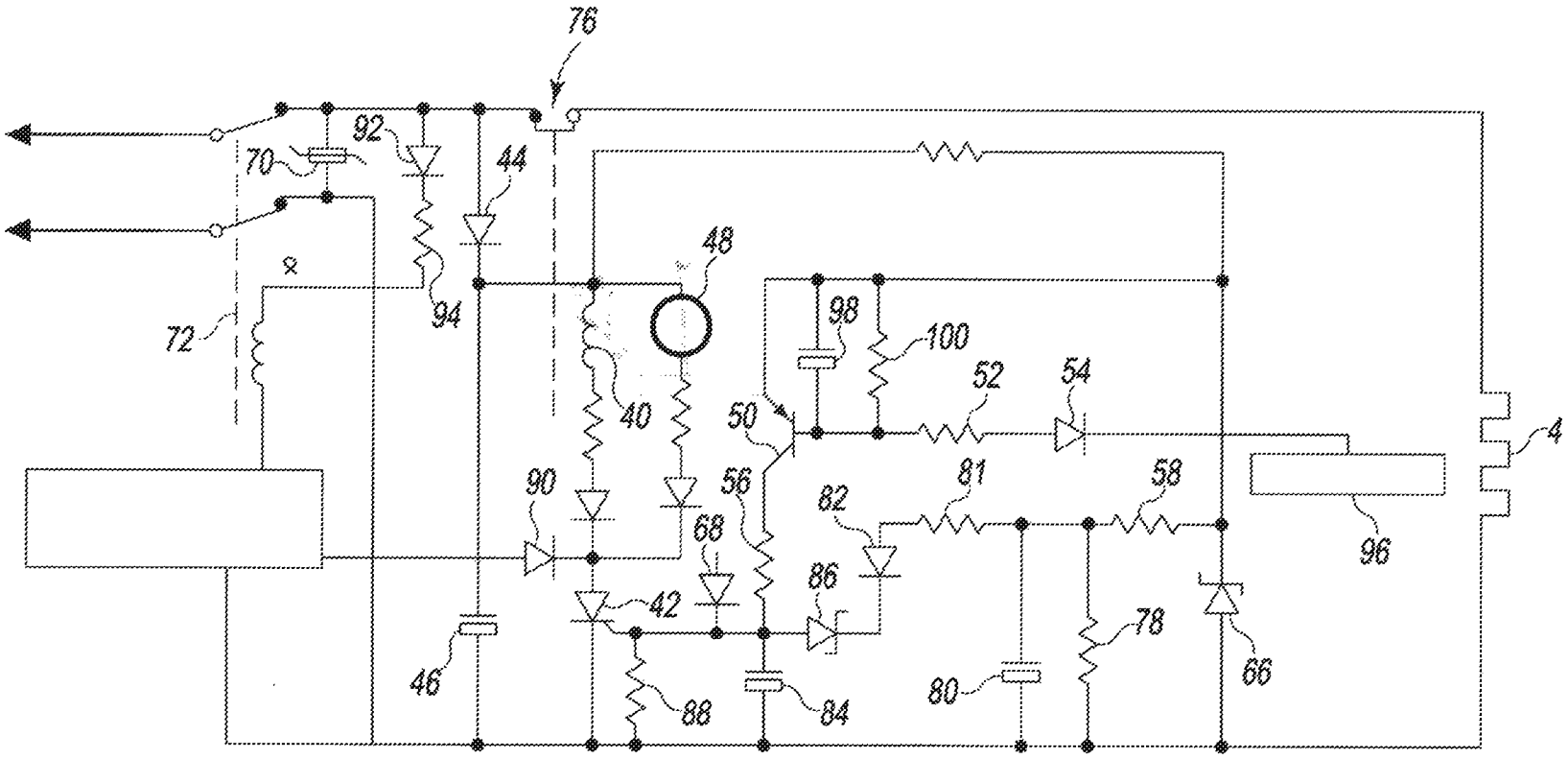
FIG. 10 is a detailed schematic circuit diagram for a pop-up toaster in accordance with a preferred embodiment of the present invention similar to that of FIG. 9, with some circuit modifications.

FIG. 10 is a further detailed schematic circuit diagram for a pop-up toaster in accordance with a preferred embodiment of the present invention similar to that of FIG. 10, with some circuit modifications. The leakage current detection, and flame sensing circuits described earlier are shown incorporated in a typical pop up toaster that uses an electromagnet for holding down the elevator carriage. The typical operational circuit diagram shown capacitors 84, 98, 80 and resistors 88, 100, 78 and zener diode 86, these components serve to provide suitable time delay and detection level settings.

If a fire in the toaster compartment occurs, it is important that the elevator carriage be held down and prevented from springing up and distributing flaming debris, the anode of diode 90 is shown connected to the elevator carriage and timer controller, it is intended to be connected to the bottom of hold down electromagnet 40 keeping it in the energized state. For pop-up toasters using a mechanically held down elevator carriage with a release solenoid, it can easily be accomplished by moving the source of solenoid power to the load side of contacts 76.

If the jamming of the elevator carriage in the down position occurs, the elements may continue to be energized and a fire could result. To avoid this possibility the timer signal is applied to the gate of SCR 42, energizing the relay 40 and removing power from the heating element.

The opportunity exists in most cases for integration of the described safety circuits into the existing appliance circuitry, the use of common circuitry would provide a further benefit of reducing cost and complexity.

Figure 11:
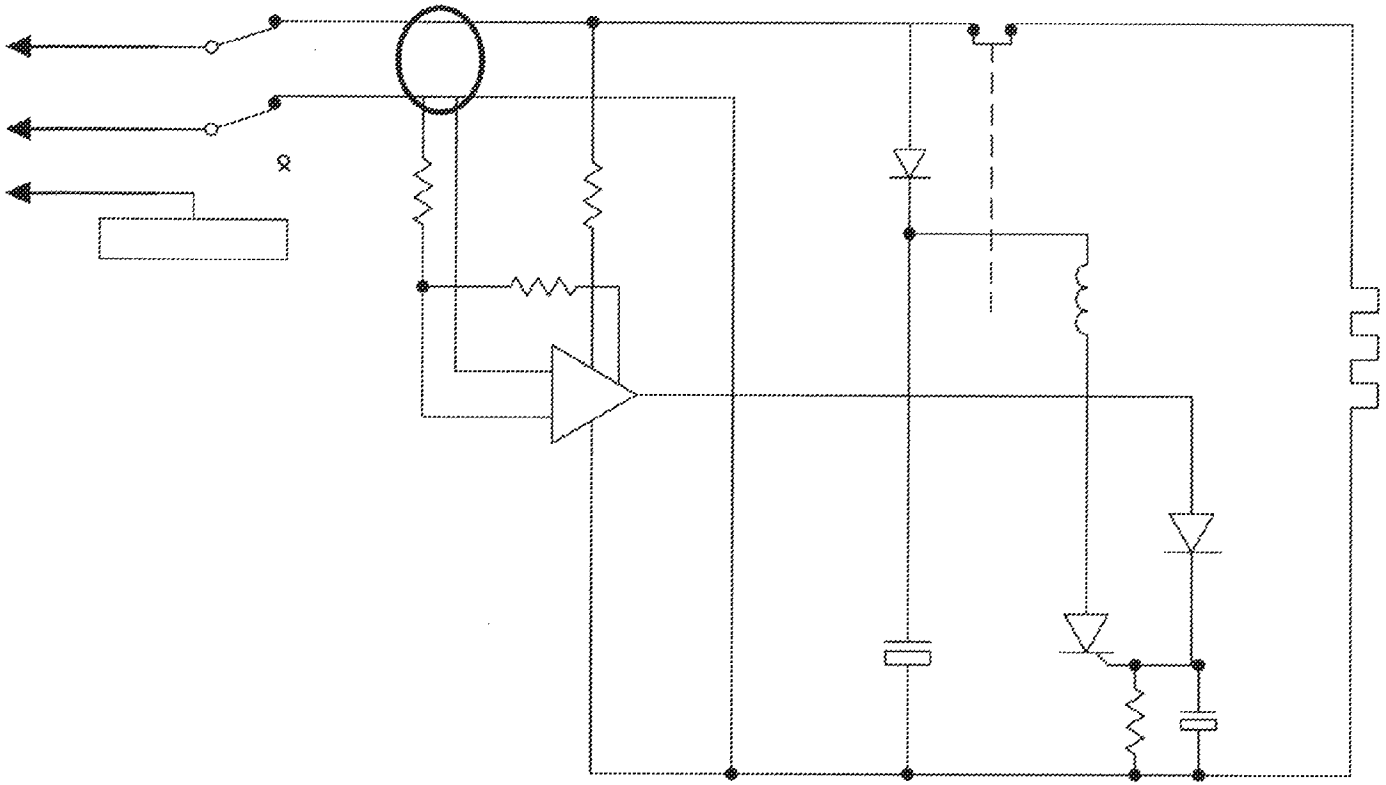
FIG. 11 illustrates a typical differential current sensing circuit for appliances supplied by a three wire cord set.

The circuits described above are not suitable for appliances supplied by a three wire cord (L-N-G) in which the metal casing is grounded. Other techniques such as differential current sensing can be used. FIG. 11 illustrates a typical and well known approach used with appliances provided with three wire cords. FIG. 11 depicts a typical differential current circuit for detecting leakage currents this art technique is well known and effective, however it has an economic disadvantage because of the added cost.

However inclusion of the leakage current protection described above offers a high degree of protection for two wire appliances that suggests the need for a three wire cord with grounding may not be necessary. Replacing a three wire cord, with the two wire protective circuit arrangement of this invention will provide a cost savings for the appliance manufacturer.

The examples set forth above represent the basic circuit approach for achieving a substantially higher degree of safety, modifications to the basic concept may be necessary for certain applications to set sensor detection levels, provide improved immunity to electrical disturbances, adding appropriate time delay capacitors and surge suppression components.

While a preferred embodiment of the circuit arrangement of this invention which provides enhanced safety for electrical appliances such as toasters, rotisseries and toaster ovens has been shown, it should be apparent to those skilled in the art that what has been shown and described is considered at present to be a preferred embodiment of the circuit arrangement and system of this invention. While a preferred embodiment of the circuit arrangement of this invention has been shown and described other circuit arrangements are contemplated by this invention. In accordance with the Patent Statutes, changes may be made in the enhance safety arrangement for electrical appliances of this invention without actually departing from the true spirit and scope of this invention. The appended claims are intended to cover all such changes and modifications which fail in the true spirit and scope of this invention.

The invention claimed is:

1. A circuit arrangement for providing enhanced safety for a pop up type toaster having a heating element comprising:

a power switch having an actuating mechanism for opening and closing contacts connecting the toaster to a power source, the contacts being closed to energize the toaster when a user initiates use of the toaster by lowering a pop up carriage, a timing device being actuated upon energization of the toaster, said timing device actuating opening of said contacts to de-energize the toaster after a predetermined time, a carriage holding device operably coupled to the timing device and serving to maintain the pop up carriage in a lowered position while the carriage holding device is energized, an alternative power disconnect device for de-energizing the heating element of the toaster, a sensing device for detecting an abnormal condition in the toaster, the detection of an abnormal condition by said sensing device energizing said alternative power disconnect device to de-energize the heating element of the toaster, while maintaining energization of the carriage holding device to, in turn, maintain the pop up carriage in the lowered position.

2. The circuit arrangement of claim 1, including two or more sensing devices.

3. The circuit arrangement of claim 1, wherein the sensing device is light sensitive.

4. The circuit arrangement of claim 3 including a switching device, which in its conductive state energizes said alternate power disconnect device.

5. The circuit arrangement of claim 4, wherein the sensing of light by said light sensitive device provides a signal to said switching device to cause it to enter its conductive state, energizes said alternate power disconnect device, whereby power is removed from the heating element.

6. The circuit arrangement of claim 1, wherein the sensing device is a semiconductor device which is biased to its conductive state by the occurrence of a low level electrical current flow between the metal casing of the toaster and an electrically live part, to provide a signal to said switching device to cause it to enter its conductive state, energizes said alternate power disconnect device, whereby power is removed from the heating element.

7. A circuit arrangement for providing enhanced safety for a pop up type toaster having a heating element comprising:

a power switch having an actuating mechanism for opening and closing contacts connecting the toaster to a power source, the contacts being closed to energize the toaster when a user initiates use of the toaster by lowering a pop up carriage, a timing device being actuated upon energization of the toaster, said timing device actuating opening of said contacts to de-energize the toaster after a predetermined time, a carriage holding device operably coupled to the timing device and serving to maintain the pop up carriage in a lowered position while the carriage holding device is energized, an alternative power disconnect device for de-energizing only the heating element of the toaster, a sensing device for detecting an abnormal condition in the toaster, the detection of an abnormal condition by said sensing device, to cause said alternative power disconnect device to de-energize the heating element of the toaster while maintaining energization of the carriage holding device to, in turn, maintain the pop up carriage in the lowered position, and an alarm device, said alarm device providing an alarm when said sensing device detects an abnormal condition.

8. A circuit arrangement for providing enhanced safety for a pop up type toaster having a heating element comprising:

a power switch having an actuating mechanism for opening and closing contacts connecting the toaster to a power source, the contacts being closed to energize the toaster when a user initiates use of the toaster by lowering a pop up carriage, a timing device being actuated upon energization of the toaster, said timing device actuating opening of said contacts to de-energize the toaster after a predetermined time, a carriage holding device operably coupled to the timing device and serving to maintain the pop up carriage in a lowered position while the carriage holding device is energized, an alternative power disconnect device, including a electromagnetic coil, for de-energizing the heating element of the toaster, a direct current power supply for supplying power to said electromagnetic coil through a semiconductor switch which is normally in a non-conducting state, a sensing device for detecting an abnormal condition in the toaster, the detection of an abnormal condition by said sensing device causing a signal to be applied to said semiconductor switch to cause it to conduct and thereby energize said alternative power disconnect device to de-energize the heating element of the toaster, while maintaining energization of the carriage holding device to, in turn, maintain the pop up carriage in the lowered position.

9. The circuit arrangement of claim 1, wherein the carriage holding device comprises an electromagnet that, while energized, retains the pop up carriage in the lowered position.

10. The circuit arrangement of claim 1, wherein the carriage holding device comprises a solenoid that, while energized, retains the pop up carriage in the lowered position.

11. The circuit arrangement of claim 7, wherein the carriage holding device comprises an electromagnet that, while energized, retains the pop up carriage in the lowered position.

12. The circuit arrangement of claim 7, wherein the carriage holding device comprises a solenoid that, while energized, retains the pop up carriage in the lowered position.

13. The circuit arrangement of claim 8, wherein the carriage holding device comprises an electromagnet that, while energized, retains the pop up carriage in the lowered position.

14. The circuit arrangement of claim 8, wherein the carriage holding device comprises a solenoid that, while energized, retains the pop up carriage in the lowered position.

* * * * *